US005734954A

United States Patent [19]

Eklund et al.

[11] Patent Number: 5,734,954

[45] Date of Patent: Mar. 31, 1998

[54] HYBRID SCAVENGELESS DEVELOPMENT USING A POWER SUPPLY CONTROLLER TO PREVENT TONER CONTAMINATION

[75] Inventors: Elliott A. Eklund, Penfield; Gerald M. Fletcher, Pittsford; Dan A. Hays, Fairport, all of N.Y.

[73] Assignee: Xerox Corporation, Stamford, Conn.

[21] Appl. No.: 646,204

[22] Filed: May 7, 1996

[51] Int. Cl.[6] ..... G03G 15/08

[52] U.S. Cl. ..... 399/266; 399/291

[58] Field of Search ..... 399/266, 279, 399/290, 291

[56] References Cited

U.S. PATENT DOCUMENTS 5,034,775 7/1991 Folkins ..... 399/266 X
5,172,170 12/1992 Hays et al. ..... 399/266
5,206,693 4/1993 Folkins ..... 399/291
5,270,782 12/1993 Floyd ..... 399/266 X
5,311,258 5/1994 Brewington et al. ..... 399/266
5,404,208 4/1995 Edmunds ..... 399/266

*Primary Examiner*—Fred L. Braun
*Attorney, Agent, or Firm*—Lloyd F. Bean, II

[57] ABSTRACT

An apparatus for developing a latent image recorded on a surface, including a housing defining a chamber storing a supply of developer material including toner and carrier beads. A toner donor member is spaced from the surface and is adapted to transport toner to a region opposed from the surface. A magnetic roller conveys the toner material in the chamber of the housing onto the donor member. An electrode member is spaced near the surface of a donor roll, the electrode member electrically biased by a power supply to detach toner from the donor member as to form a toner cloud for developing the latent image. A power supply controller, in communication with the power supply, is adapted to adjust the electrode member electrical biasing to avoid air breakdown induced contamination of the electrode member with toner.

5 Claims, 4 Drawing Sheets

HYBRID SCAVENGELESS DEVELOPMENT USING A POWER SUPPLY CONTROLLER TO PREVENT TONER CONTAMINATION

This invention relates generally to a development apparatus used in ionographic or electrophotographic imaging and printing apparatuses and machines, and more particularly is directed to a power supply controller to prevent toner contamination of wires which are used to produce a toner cloud in said development system.

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image-on-image processing, superimposes toner powder images of different color toners onto the photoreceptor prior to the transfer of the composite toner powder image onto the substrate. While the image-on-image process is beneficial, it has several problems. For example, when recharging the photoreceptor in preparation for creating another color toner powder image, it is important to level the voltages between the previously toned and the untoned areas of the photoreceptor. Moreover, the viability of printing system concepts such as image-on-image processing usually requires development systems that do not scavenge or interact with a previously developed image. Several known development systems, such as conventional magnetic brush development and jumping single component development, are interactive with the image bearing member, making them unsuitable for use with image-on-image processes.

One particular version of a scavengeless development system uses a plurality of electrode wires closely spaced from a toned donor roll. The donor roll is loaded with toner using conventional two component magnetic brush development. An AC voltage is applied to the wires to generate a toner cloud in the development zone. The electrostatic fields from the latent image attract toner from the toner cloud to develop the latent image. It has been found in such development systems that contamination of the electrode wires, due to permanently attached toner particles, causes various types of image defects on the resulting prints.

SUMMARY OF THE INVENTION

Briefly, the present invention obviates the problems noted above by utilizing an apparatus for developing a latent image recorded on a surface, including a housing defining a chamber storing a supply of developer material comprising toner. A toner donor member is spaced from the surface and is adapted to transport toner to a region opposed from the surface. A magnetic brush conveys said developer material from the chamber of said housing to said donor member, depositing a layer of toner on said donor member. An electrode member is spaced near the surface of a donor roll, the electrode member electrically biased by a power supply to detach toner from said donor member as to form a toner cloud for developing the latent image. A power supply controller, in communication with said power supply, is adapted to adjust the electrical biasing of said electrode member to avoid toner contamination of said electrodes due to air breakdown.

Inasmuch as the art of electrophotographic printing is well known, the various processing stations employed in the printing machine will be shown hereinafter schematically and their operation described briefly with reference thereto.

Figure 1:
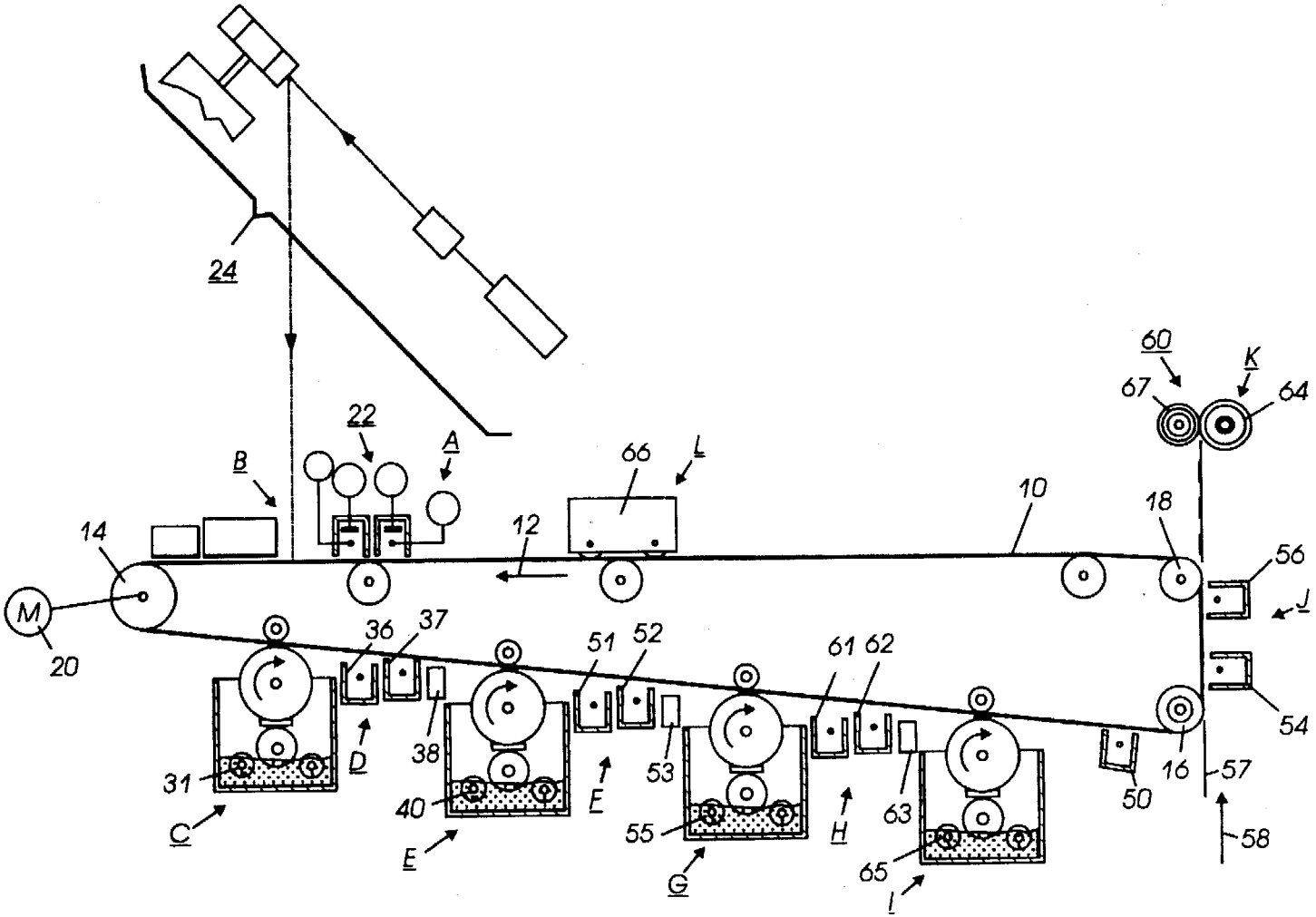
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
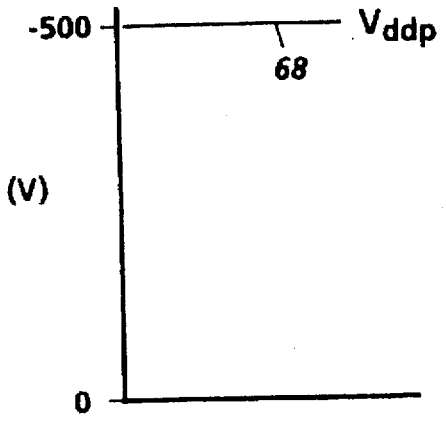
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
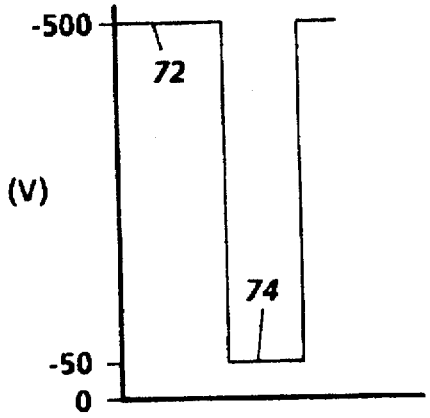
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development systems E, G, and I. The first development station C deposits a first color, say black, of negatively charged toner 31 onto the image area. That toner is attracted to the less negative sections of the image area and repelled by the more negative sections. The result is a first toner powder image on the image area.

Figure 3:
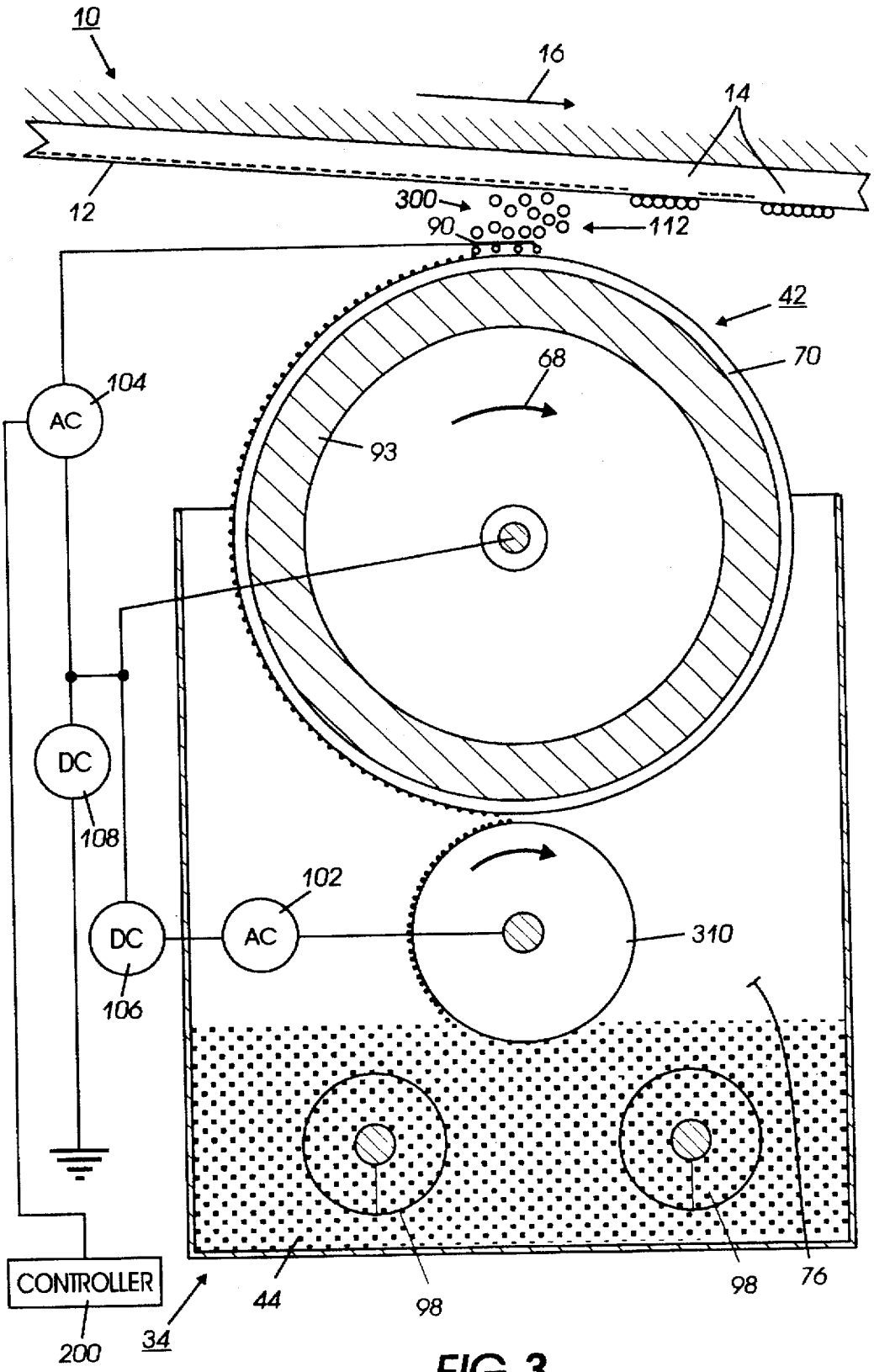
FIG. 3 is a schematic elevational view showing the development apparatus used in the FIG. 1 printing machine.

FIG. 3 is a detailed view of the first development station C, which incorporates a donor roll 42 in development system 34. Electrode grid 90 is electrically biased with an AC voltage relative to donor roll 42 for the purpose of detaching toner therefrom so as to form a toner powder cloud 112 in the gap between the donor roll and photoconductive surface. Both electrode grid 90 and donor roll 42 are biased at a DC potential 108 for discharge area development (DAD). The discharged photoreceptor image attracts toner particles from the toner powder cloud to form a toner powder image thereon.

Figure 2C:
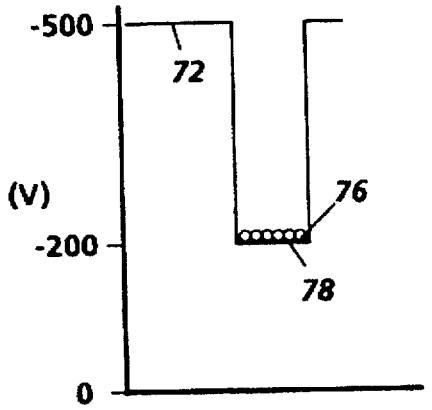
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
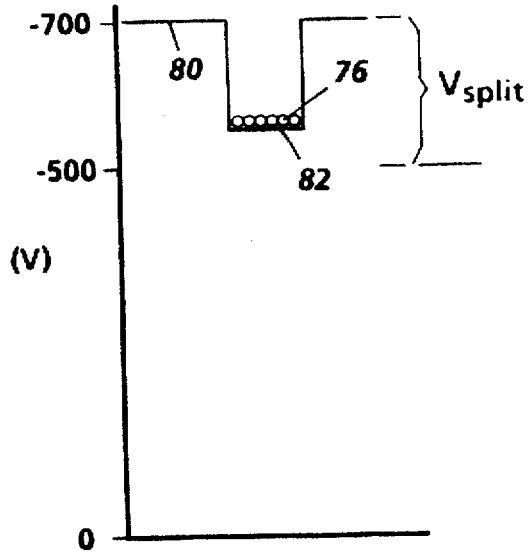
FIG. 2D shows a typical voltage profile of the image area after being recharged by a first recharging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area reach a voltage level 80 of about −700 volts. The first recharging device 36 is preferably a DC scorotron.

Figure 2E:
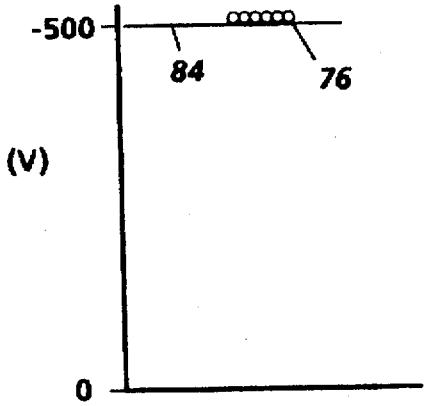
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
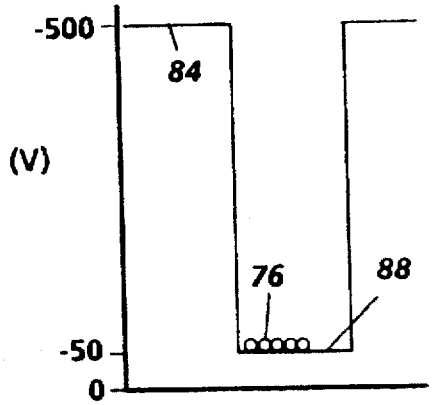
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 volts as denoted by the level 84. However, in the illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is essentially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similarly to the recharging devices 36 and 37. Briefly, the first recharge device 51 overcharges the image areas to a greater absolute potential than that ultimately desired (say −700 volts) and the second corona recharging device 52, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 53 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 57 from the photoreceptor belt 10.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 3 in greater detail, the development system 34 is scavengeless, meaning that the developer or toner from system 34, which is delivered to development zone 300, must not interact significantly with an image already formed on the image receiver 10. Thus, the system 34 is also known as a non-interactive development system. The development system 34 comprises a donor structure in the form of a roller 42, which conveys a toner layer to the region under the wire assembly 90. The toner layer can be formed on the donor roll 42 by either a two component developer (i.e. toner and carrier) or a single component developer (toner only). The development zone contains an AC biased electrode structure 90 self-spaced from the donor roll 42 by the toner layer. The toner deposited on donor roll 42 may be positively or negatively charged. The donor roll 42 may be coated with a ceramic coating, or with TEFLON-S (trademark of E. I. DuPont De Nemours) loaded with carbon black.

For donor roll loading with two component developer, a conventional magnetic brush 310 can be used for depositing the toner layer onto the donor structure. As illustrated in copending patent application U.S. Ser. No. 396,153, filed on Aug. 21, 1989 now abandoned, (D/89018), U.S. Pat. No. 5,032,872 (D/89017) and U.S. Pat. No. 5,034,775 (D/89380), the disclosures of which are totally incorporated herein by reference. Also, U.S. Pat. No. 4,809,034 describes two-component loading of donor rolls and U.S. Pat. No. 4,876,575 discloses another combination metering and charging device suitable for use in the present invention.

For single component loading of donor roll 42, the combination metering and charging device may comprise any suitable device for depositing a monolayer of well charged toner onto the donor structure 42. For example, it may comprise an apparatus such as described in U.S. Pat. No. 4,459,009, wherein the contact between weakly charged toner particles and a triboelectrically active coating contained on a charging roller results in well charged toner. Other combination metering and charging devices may be employed.

With continued reference to FIG. 3, augers, indicated generally by the reference numeral 98, are located in chamber 76 of housing 44. Augers 98 are mounted rotatably in chamber 76 to mix and transport developer material. The augers have blades extending spirally outward from a shaft. The blades are designed to advance the developer material in the axial direction substantially parallel to the longitudinal axis of the shaft. As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are in the chamber of the developer housing with the toner particles having a constant charge.

The electrode structure 90 is comprised of one or more thin (i.e. 50 to 100 microns in diameter) tungsten or stainless steel wires which are lightly positioned against the toner on the donor structure 42. The distance between the wires and the donor is self-spaced by the thickness of the toner layer which is approximately 25 microns. The extremities of the wires are supported by end blocks (not shown) at points slightly below a tangent to the donor roll surface. Mounting the wires in such manner makes the self-spacing insensitive to roll runout. A suitable scavengeless development system for incorporation in the present invention is disclosed in U.S. Pat. No. 4,868,600 granted to Hays et al on Sep. 19, 1989 and incorporated herein by reference. As disclosed in the '600 patent, a scavengeless development system may be conditioned to selectively develop one or the other of the two image areas (i.e. discharged and charged image areas) of the images by the application of appropriate AC and DC voltage biases to the wires in electrode structure 90 and the donor roll structure 42.

An AC power source 104 applies an electrical bias of, for example, 1000 volts peak-to-peak at 4 kHz between the electrode structure 90 and the donor roll 42. A DC bias from 0 to −400 volts is applied by a DC power source 108 to the donor roll 42. The AC voltage applied between the set of wires 90 and the donor structure 42 establishes AC fringe fields serving to liberate toner particles from the surface of the donor structure 42 to form the toner cloud 112 in the development zone 300. The electric field which exists in the development zone 300, due to the electrostatic image, the charged toner layer on the donor roll and the voltages applied to the electrode structure 90 and the donor roll 42, controls the deposition of toner onto the image receiver.

It has been found through extensive research efforts by the applicants that air breakdown near the electrode wires is a main mechanism for wire contamination and the generation of low charge and wrong sign toner. Wire contamination is accelerated when there is only a small amount of toner on the donor roll, such as at the last one or two wires during development and at all the wires during detoning and initial retoning of the donor roll. The resulting decrease in dielectric thickness and gap spacing between wires and donor roll results in a dramatic increase in current (due to air breakdown between the wires and the donor roll). When there is little or no toner on the donor roll this rise in current has been correlated to permanent attachment of toner to the wires, resulting in defects in the developed toner image.

The power supply controller of the present invention can operate in three modes to avoid air breakdown induced wire contamination. In the first mode, the power supply controller 200 shuts off the AC voltage to the wires during detoning and initial retoning times. In a second mode the power supply controller 200 avoids air breakdown induced wire contamination by limiting the current between the wires and the donor roll, with the maximum deliverable current preset to below the current threshold for wire contamination. In this mode, it is preferred that the wire voltage remains constant until the critical current threshold is exceeded, whereupon the power supply controller 200 would begin to lower the voltage to limit the current. It should be evident that power supply controller 200 could control each wire independently as well as collectively. In a third mode, power supply controller 200 adjusts the peak AC voltage continuously to maintain a constant current between the wires and the donor roll. The operating voltage will be at a level dependent on the capacitance between the wires and the donor roll. When only a small amount of toner is on the donor roll, the capacitance will be high and the applied voltage will drop. This will minimize the amount of air breakdown that can occur under this stress contamination condition. This mode is especially effective when the capacitance between the wires and donor roll is much larger than the stray input capacitance from input leads.

The total capacitance of the electrode structure/donor roll system also has implications for current sensing. The total current passing between the electrode structure 90 and the donor roll 42 is a combination of a capacitive component, due to the rapidly varying AC voltages applied to the electrode structure, and the current due to air breakdown between the wires and the donor roll. In general, the magnitude of the total current is much larger than the changes in capacitive current due to variations in the toner layer thickness on the donor roll and than the current due to the onset of air breakdown. Therefore, it may be desirable to provide circuitry in order to accurately sense these small changes in the total current.

Figure 4:
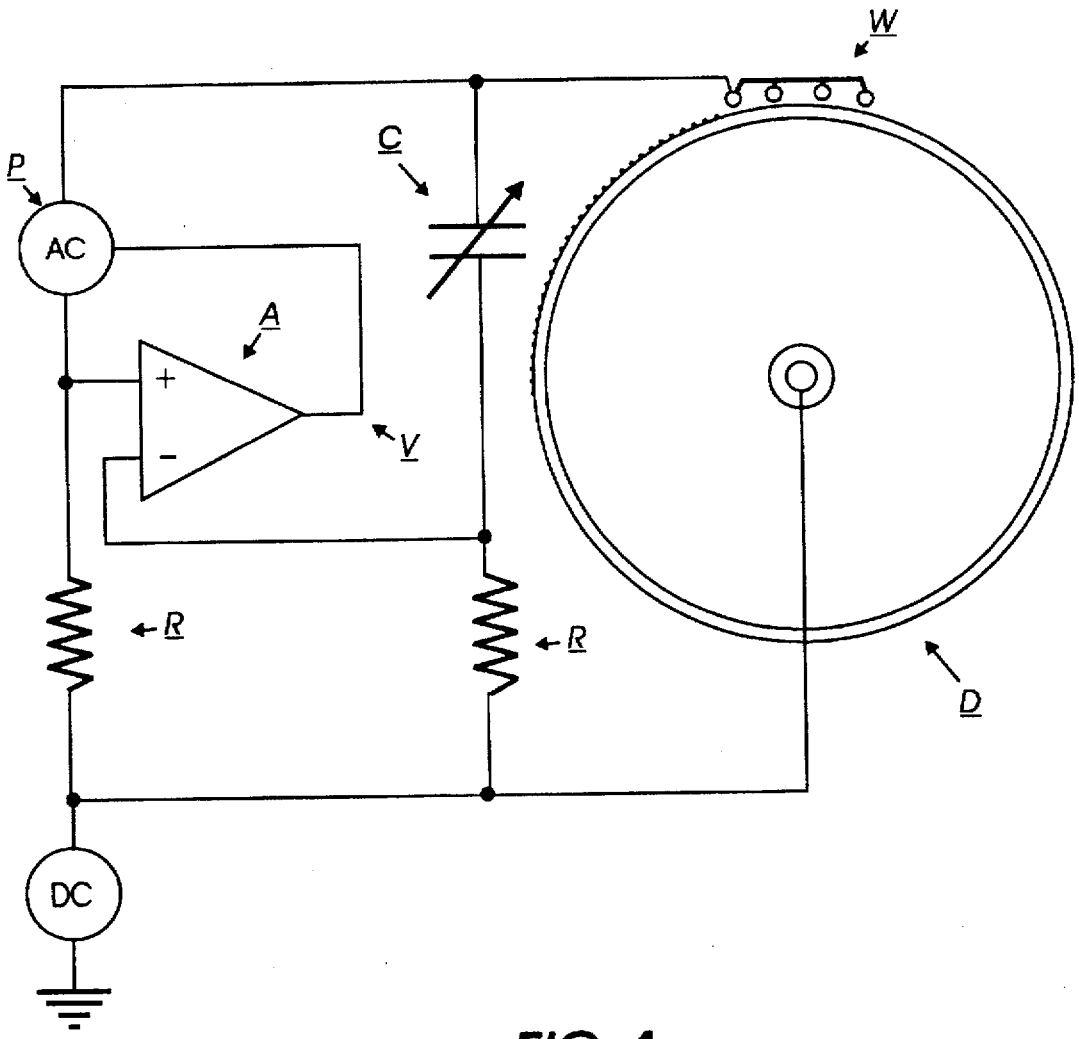
FIG. 4 is an electrical schematic showing a typical embodiment of a power supply controller and its implementation in the development apparatus in FIG. 3.

By an approach such as the one shown in FIG. 4, the constant current option of the present invention can be further enhanced. In this approach, the capacitive component of the current flowing between the wires W and a fully toned donor roll D, due to the capacitance between said wires and said toned roll, is distinguished from the total current flowing in this branch, allowing any additional current over and above this level to be detected and thereby used to adjust the output of AC power supply P. This is accomplished by first adjusting the variable capacitor C to substantially match the capacitance between the wires W and fully toned donor roll D, thus bringing the output signal V from differential amplifier A to some nominal low setpoint level. When toner is removed from the donor, leaving it in a less than fully loaded state, the output signal V will tend to rise significantly (for constant AC voltage from power supply P), due to the increased capacitance between the wires and donor roll and the resulting increased current in this branch. Similarly, if any air breakdown occurs between the wires and the donor roll, the total current in this branch will once again increase above that between the wires and a fully toned donor, and the output signal V will once again tend to rise if the AC voltage is held constant. By use of the appropriate circuitry, the increasing output signal V under these conditions can be used to drop the AC output voltage of power supply P, thus avoiding toner contamination of the wires W due to air breakdown and bringing the output signal V back to its nominal setpoint. Such circuitry is well known to those skilled in the art. By this method, the AC signal applied to the wires is controlled continuously to remain below the predetermined threshold for air breakdown and resultant contamination of the wires by toner attachment thereto.

An advantageous feature of this third mode of operation is that the wire voltages are dynamically adjusted to compensate for time dependent changes in toner layer thickness on the donor roll. Also, variations in the electrical properties of the donor roll overcoating, which have also been found to affect the current threshold for air breakdown between wires and donor roll, are compensated for.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on a surface, comprising:

a housing defining a chamber storing a supply of developer material comprising toner;

a toner donor member spaced from the surface and being adapted to transport toner to a region opposed from the surface;

means for conveying said developer material in the chamber of said housing onto said donor member;

an electrode member spaced near the surface of said donor member, said electrode member being electrically biased by a power supply to detach toner from said donor member as to form a toner cloud for developing the latent image; and a power supply controller, in communication with said power supply, adapted to adjust said electrode member electrical biasing to avoid air breakdown toner contamination, said power supply controller has a mode of operation wherein said power supply controller shuts off the voltage to the electrode member during detoning and initial retoning.

2. The apparatus according to claim 1, wherein said electrode member comprises a plurality of wires.

3. The apparatus according to claim 2, wherein at least one of said plurality of wires is independently controlled by said power supply controller.

4. An apparatus for developing a latent image recorded on a surface, comprising:

a housing defining a chamber storing a supply of developer material comprising toner;

a toner donor member spaced from the surface and being adapted to transport toner to a region opposed from the surface;

means for conveying said developer material in the chamber of said housing onto said donor member;

an electrode member spaced near the surface of said donor member, said electrode member being electrically biased by a power supply to detach toner from said donor member as to form a toner cloud for developing the latent image; and a power supply controller, in communication with said power supply, adapted to adjust said electrode member electrical biasing to avoid air breakdown toner contamination, said power supply controller has a mode of operation wherein said power supply controller limits current between the electrode member and the donor member to a maximum deliverable current preset below toner contamination.

5. An apparatus for developing a latent image recorded on a surface, comprising:

a housing defining a chamber storing a supply of developer material comprising toner;

a toner donor member spaced from the surface and being adapted to transport toner to a region opposed from the surface;

means for conveying said developer material in the chamber of said housing onto said donor member;

an electrode member spaced near the surface of said donor member, said electrode member being electrically biased by a power supply to detach toner from said donor member as to form a toner cloud for developing the latent image; and a power supply controller, in communication with said power supply, adapted to adjust said electrode member electrical biasing to avoid air breakdown toner contamination, said power supply controller has a mode of operation wherein said power supply controller controls voltage to the electrode member so that the current between said electrode member and the donor member remains constant and below a critical current threshold.

* * * * *